US006106115A

United States Patent [19]

Mueller et al.

[11] Patent Number: 6,106,115

[45] Date of Patent: Aug. 22, 2000

[54] IMAGE FORMING METHOD USING TRANSPARENT PRINTER MEDIA WITH REFLECTIVE STRIPS FOR MEDIA SENSING

[75] Inventors: Bruce E. Mueller, Escondido; Mark Wisnosky, Poway, both of Calif.; Todd R. Medin, Vancouver, Wash.; William D. Meyer, Ramona; Peter C. Morris, San Diego, both of Calif.

[73] Assignee: Hewlett-Packard Company, Palo Alto, Calif.

[21] Appl. No.: 08/932,666

[22] Filed: Sep. 18, 1997

Related U.S. Application Data

[60] Division of application No. 08/235,769, Apr. 29, 1994, Pat. No. 5,723,202, which is a continuation-in-part of application No. 08/137,388, Oct. 14, 1993, Pat. No. 5,467,119, which is a continuation of application No. 07/876,986, May 1, 1992, abandoned.

[51] Int. Cl.[7] ..... B41J 11/46; B41J 11/42

[52] U.S. Cl. ..... 347/104; 347/218

[58] Field of Search ..... 400/708; 347/221, 347/215, 218, 101, 104

[56] References Cited

U.S. PATENT DOCUMENTS

| | | | |
|---|---|---|---|
| 3,519,124 | 7/1970 | Barker et al. | 161/149 |
| 3,618,752 | 11/1971 | Barker et al. | 206/57 |
| 3,944,710 | 3/1976 | Parent | 428/412 |
| 3,949,148 | 4/1976 | Akman | 428/500 |
| 4,051,285 | 9/1977 | Kramer | 428/43 |
| 4,358,192 | 11/1982 | Goldberg et al. | 354/299 |
| 4,385,826 | 5/1983 | Itoh | 355/14 FU |
| 4,605,461 | 8/1986 | Ogi | 156/233 |
| 4,728,963 | 3/1988 | Rasmussen et al. | 346/25 |
| 4,751,528 | 6/1988 | Spehrley, Jr. et al. | 346/140 R |
| 4,780,078 | 10/1988 | Masui | 432/60 |
| 4,788,563 | 11/1988 | Omo et al. | 346/140 R |
| 4,933,684 | 6/1990 | Tasaka et al. | 346/1.1 |
| 4,952,781 | 8/1990 | Kozaiku | 219/469 |
| 4,970,528 | 11/1990 | Beaufort eta l. | 346/25 |
| 5,005,025 | 4/1991 | Miyakawa et al. | 346/25 |
| 5,021,805 | 6/1991 | Imaizumi et al. | 346/76 |
| 5,041,846 | 8/1991 | Vincent et al. | 346/25 |
| 5,130,726 | 7/1992 | Fukushima et al. | 346/140 R |
| 5,146,087 | 9/1992 | VanDusen | 250/271 |
| 5,287,123 | 2/1994 | Medin et al. | 346/140 R |
| 5,422,659 | 6/1995 | Titterington et al. | 347/101 |

FOREIGN PATENT DOCUMENTS

| | | |
|---|---|---|
| 0 288 568 B1 | 7/1987 | European Pat. Off. . |
| 0 283 048 A2 | 3/1988 | European Pat. Off. . |
| 0 373922 | 6/1990 | European Pat. Off. . |
| 55-015874 | 2/1980 | Japan . |
| 84670 | 6/1980 | Japan . |
| 57-76554 | 5/1982 | Japan . |
| 57-122448 | 7/1982 | Japan . |
| 130864 | 6/1987 | Japan . |
| 62-288042 | 12/1987 | Japan . |

OTHER PUBLICATIONS

European Search Report for European Application, EP 9510 2340, Oct. 22, 1997.

English Abstract for JP55015874, Matsui Shikiso Kagaku Kogyosho:KK.

*Primary Examiner*—Huan Tran

[57] ABSTRACT

A transparent medium for printers and plotters having optical edge and media sensors has one or more reflective strips applied to the non-image side to trip the sensors. The reflective strips can include a narrow strip along one lateral edge to locate the edge, and a wider strip along the other lateral edge to locate the edge and trip the media sensor. The strips are applied by a pressure-sensitive adhesive, and are removed after the printing operations on the medium. The reflective strips can be formed of the same transparent base as the medium, with fillers added to provide sufficient opacity to trip the optical sensors.

15 Claims, 5 Drawing Sheets

IMAGE FORMING METHOD USING TRANSPARENT PRINTER MEDIA WITH REFLECTIVE STRIPS FOR MEDIA SENSING

RELATED APPLICATION

This is a division of application Ser. No. 08/235,769, filed Apr. 29, 1994, now U.S. Pat. No. 5,723,202 which in turn is a continuation-in-part of application Ser. No. 08/137,388, filed Oct. 14, 1993, now U.S. Pat. No. 5,467,119 which in turn is a continuation of Ser. No. 07/876,986, filed May 1, 1992, now abandoned.

TECHNICAL FIELD

This invention relates to printers and plotters having the capability of recording an image on a plurality of different media types, and more particularly to an improved transparent media having marginal reflective strips applied thereto for sensing by printer/plotter media sensors.

BACKGROUND OF THE INVENTION

Printers and plotters in use today for printing text/graphics typically have the capability of printing on various types of print media, such as plain paper, coated paper, and the like. Such printers and plotters typically include sensors for sensing the presence of the print medium in the media path, and the medium edges. Large scale plotters typically support roll-form print media, i.e., a supply of paper on a roll. One such device is the Design Jet product family of large scale plotters marketed by Hewlett-Packard Company. A cutter is employed to cut the medium after the plot is completed so that the finished plot is separated from the roll.

The typical printer/plotter cannot support a conventional transparent medium such as polyester. This is because a device such as the Design Jet plotter employs sensors for performing medium edge detection and medium present functions which operate by sensing reflected optical radiation from a surface of the medium. A typical transparent polyester medium such as polyethylene terephthalate (PET) has a reflectance of less than 30 percent, which is insufficient to reliably trip the optical sensor.

The use of a roll of transparent medium with a paper backing is known. The roll thus includes a layer of the transparent medium and a backing layer of paper, which is not adhered to the under surface of the transparent medium. The paper backing trips the sensors, and enables the printer to operate on the transparent medium. This technique suffers from several disadvantages. The roll trailing edges do not necessarily line up or match, causing a loss of expensive print media at the roll end when the paper backing ends before the transparent medium. Further, the paper thickness adds to the weight of the roll, reduces the length of print medium which can be put on a roll of a given thickness, and increases the media advancement error. A further disadvantage is that, due to hygroscopic and thermal expansion effects of the paper backing, the roll can telescope lengthwise, which in extreme cases could prevent the roll from being loaded into the machine. The lateral edges of the paper backing may not coincide with the edges of the transparent medium, leading to edge sensing inaccuracies.

SUMMARY OF THE INVENTION

A transparent print medium is described for recording image elements in a printer or plotter device. The print medium includes a sheet of transparent material comprising opposed first and second surfaces and opposed first and second lateral edges. The first surface is the image surface for recording thereon image elements. Removably affixed to the second surface of the sheet is an opaque reflective layer coincident with lateral edges of the transparent medium and coterminous with a transverse edge thereof. In one form, the opaque reflective layer includes a first reflective layer portion at the first lateral edge of the medium, a second reflective layer portion at the second lateral edge of the medium, and a third reflective layer portion intermediate to the lateral edges. In a preferred embodiment, the first reflective layer portion is defined by a first reflective strip of reflective layer material, and the second and third reflective layer portions are defined by a second reflective strip of reflective layer material. The strips are affixed to the sheet surface by a layer of pressure-sensitive adhesive, and are easily stripped away after the printing operation has been completed.

In a preferred embodiment, the transparent medium is a layer of transparent polyethylene terephthalate (PET), and the reflective layer portions are defined by one or more layers of PET filled with barium sulfate to provide a desired opacity.

The invention overcomes the above-noted shortcomings of the prior art. First, the transparent print medium and reflective strips are bound together by adhesive. This ensures that the trailing edges are aligned at the end of the roll, preventing medium waste. Second, the backing thickness achievable with the removable strips in accordance with the invention, even including the adhesive, is approximately one third thinner than is achievable using backing paper. The weight savings, compared with full paper backing, amount to about three pounds for a 75 foot roll, the maximum quantity allowed on a roll with the present typical outside diameter. With the invention, additional print media material can be wound onto the roll core while maintaining the required outside diameter. Another advantage is the medium advance accuracy. For example, the Hewlett-Packard "Design Jet" product family is optimized for accurately advancing a print medium with a thickness of about 5 mils. In an exemplary embodiment of this invention, the thickness at the edges of the print medium with the removable strips is 6.5 mils; in contrast, the thickness of a print medium with full paper backing is typically about 7.4 mils. Thus the plotting accuracy of a plotter employing a print medium in accordance with this invention is improved in comparison with that achieved by a transparent medium with full paper backing, due to the smaller over-advancement of the print medium. Since the strips can be fabricated from a material having very similar thermal and hygroscopic expansion coefficients to the print medium material, no telescoping of the roll will occur. And since the print medium and removable strips are adhesively bound, the edges are held coincident, resulting in very accurate edge position detection.

In accordance with an aspect of the invention, a method is described for forming an image onto a transparent medium by a printing device having an optical medium sensor disposed for operation along a medium path and an optical medium sensor disposed to sense lateral edges of the print medium. The method includes the following steps:

providing a transparent print medium having removably affixed to a first surface thereof a first reflective layer portion at a first lateral edge of the medium, a second reflective layer portion at a second lateral edge of the medium, and a third reflective layer portion intermediate to the lateral edges at a position for tripping a media sensor;

loading the medium into the printing device media path and advancing it to the printing region past the media sensor;

using the media sensor to detect the presence of a print medium in the media path by interaction with reflective material;

using the optical edge sensor to locate the lateral edges of the medium by location of the outer edges of the reflective layer material; and performing printing operations on a second surface of the print medium opposed from the first surface.

The reflective layers are then removed from the medium after the printing operations have been completed.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
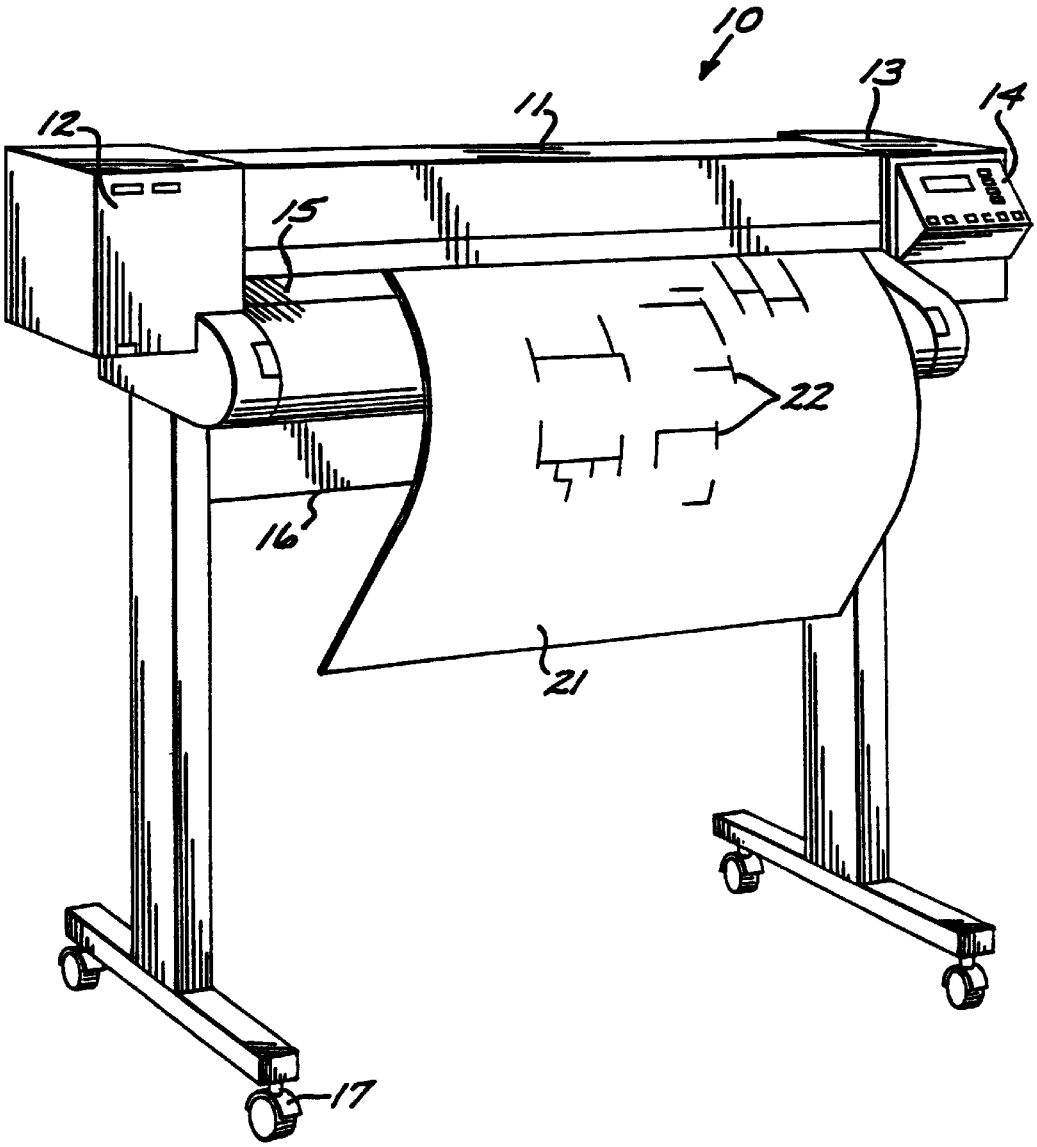
FIG. 1 is an exterior perspective view of a large scale plotter device which prints an image onto a medium supplied in roll form.

FIG. 1 illustrates a large-format plotter 10, generally comprising a housing 11 with left- and right-hand drive mechanism enclosures 12, 13. Controls and indicators 14 are disposed in the right-hand enclosure 13. A movable bed or roller 15 holds and transports a large-format piece of medium 21, on which image elements 22 have been formed by the device. A sturdy cross-girder 16 and wheeled stand 17 provide a stable platform well above floor level.

Figure 2:
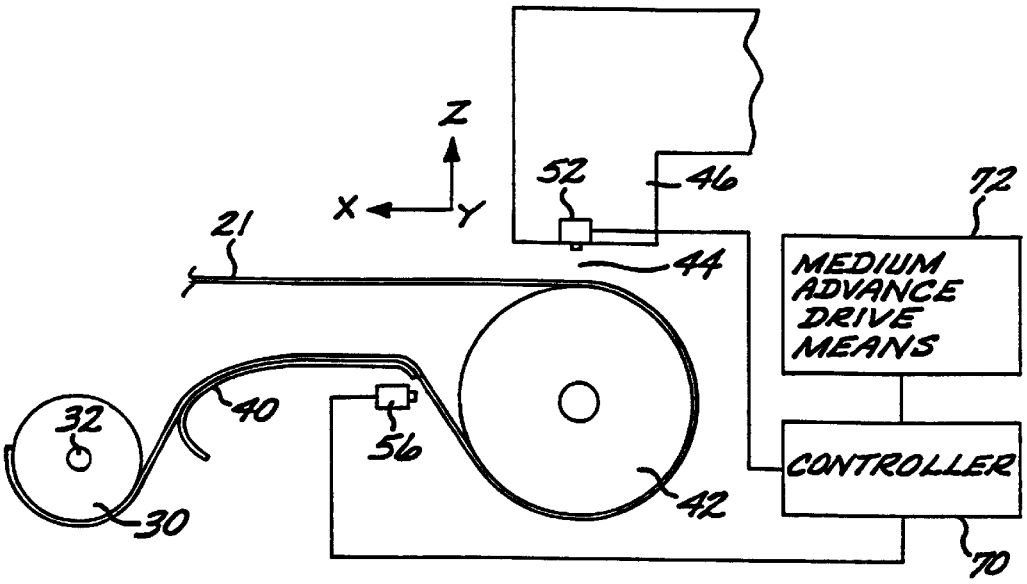
FIG. 2 is a simplified cross-sectional view of a portion of the media path through the device of FIG. 1, showing the location of two sensor devices.

FIG. 2 is a simplified cross-sectional view of a portion of the media path through the plotter 10. The medium 21 is fed from a roll indicated generally as 30, which is unwound from a roll core 32. The medium 21 is guided by an entry platen 40 to a drive roller 42 which is driven counterclockwise by a conventional roller drive system 72, under the control of the plotter controller 70, to advance the medium to a print area 44 beneath a carriage 46 carrying one or more print elements (not shown) such as thermal ink-jet printheads. The carriage 46 is driven along a swath axis Y (FIG. 3) extending orthogonal to the X-Z plane of FIG. 2. Ink is ejected by the print elements onto the exposed surface of the medium 21 at the print area 44 to form the images elements 22. The roller drive system 72 selectively drives the roller to advance the medium strip 21 to the print area, and incrementally advance the medium after each swath is printed.

The device 10 includes a media sensor 56 located to sense the presence/absence of media at the entry platen. The sensor 56 detects the presence of the medium as it is manually advanced to the platen by the user, and the controller then actuates the drive system 72 to advance the medium a predetermined distance calculated to position the leading edge of the medium at the print zone. Thus, when the user first loads the medium 21 into the machine, the leading edge is advanced manually through the medium path until the sensor 56 is tripped due to reflection of radiation from the surface of the medium. At that time, the medium drive system is actuated to advance the medium to the proper start position for commencing print operations. The sensor 56 also senses the end of the print medium roll by noting the absence of the reflected radiation once the trailing edge of the medium roll has passed by the sensor. The end-of-roll detection is used by the controller to determine whether sufficient medium remains to complete the present plot, and to terminate printing operations to avoid ejecting ink onto the roller surface in the absence of the medium.

An optical edge detect sensor 52 is mounted at an edge of the carriage 46, and is carried by the carriage. The sensor 52 is used to detect the location of the lateral edges of the medium 21 at the print area 44. Typically, once the leading edge of the print medium has been advanced to the print area 44, the controller actuates a carriage scan mechanism to cause the carriage to be scanned across the extent of the carriage scan range of movement. The lateral medium edges are located by noting the carriage position at which a transition in detector output is noted. The sensor 52 operates by detecting the presence/absence of radiation reflected from the medium surface. Thus, as the sensor is moved over the medium surface and past a lateral edge of the medium, the sensor output will diminish. Alternatively, the edge can be detected by noting the location at which the sensor output increases, as the carriage moves from one swath end stop position toward the swath midpoint.

Figure 3:
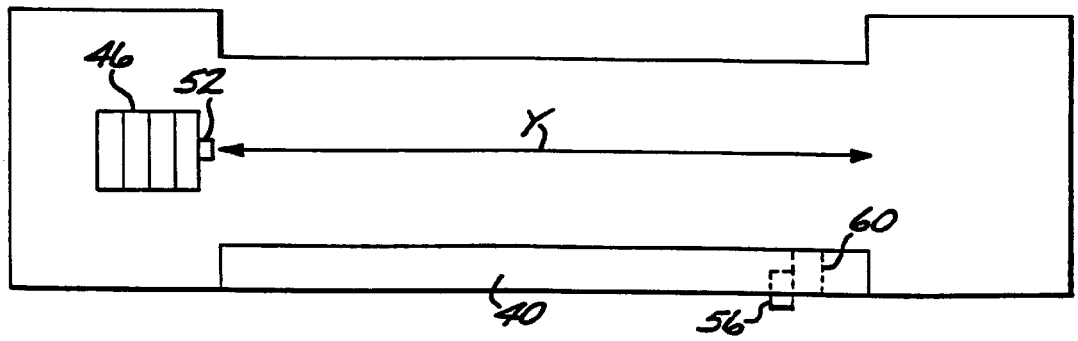
FIG. 3 is a simplified top view illustrating components at the print area of the plotter of FIG. 1.

FIG. 3 is a simplified top view of the plotter print area elements illustrating the relative position of the sensors 52 and 56 in relation to the medium path. A media loading guideline 60 is defined on the entry platen 40 to serve as a media loading guide to the user, to align the right edge of the medium strip 21 along the guideline. In an exemplary plotter, the media sensor 56 is fixed a distance from the guideline 60, e.g., 20 mm.

The sensors 52 and 56 employ energy emitting elements for directing light of a given wavelength, e.g., a wavelength in the infrared or visible range, at a location in the media path, and photodetectors tuned to the wavelength emitted by the energy emitting elements for detecting energy reflected from the media path. Thus, if a reflective medium is present at the location within the target range of the sensor, light emitted by the energy emitting element is reflected back to the photodetector comprising the sensor, which provides the sensor signal. One exemplary sensor suitable for the purpose is the Omron EE-SF5 sensor.

To the extent described above, the plotter 10 is conventional. The problem addressed by this invention is that a transparent medium such as PET does not reflect enough energy emitted by the sensor energy emitting element to reliably detect its presence. As a result, the plotter controller does not sense that a medium strip has been loaded, and cannot locate the edges of such a medium. Thus, the plotter does not support the use of a conventional transparent medium.

To solve the foregoing problem, in a preferred embodiment of the invention, a transparent medium 21 is provided for use in the plotter 10 which has thin opaque strips 21A and 21B applied to one surface 21D of the medium. The opposed surface 21C is the image recording surface which faces the carriage 46. In this exemplary embodiment, the medium 21 is fabricated of a layer of transparent PET having a thickness of 4 mils, and surface 21C has applied thereto a hydrophilic coating to accept a water-based ink deposited thereon by the printheads carried by the carriage 42. The strips 21A and 21B, in this embodiment, are 1 mil thick layers of PET filled with barium sulfate in order to provide sufficient opacity. To trip the Omron EE-SF5 sensor, at least 30 percent opacity is required. However, to provide added margin, the PET is filled with sufficient barium sulfate so that the strips have about 90 percent opacity.

An advantage of using similar materials for both the transparent layer and the reflective strips is that the thermal coefficients of expansion will likewise be similar, avoiding different telescoping effects of the transparent layer and strip layers due to thermal expansion.

The strips 21A and 21B are removably secured to the surface 21D by a layer 21E of pressure-sensitive adhesive, e.g., an acrylic pressure-sensitive adhesive, or the adhesive marketed by 3M as adhesive number 1000 ("Post-It"). In an exemplary embodiment, the adhesive layer has a thickness of about 1 mil. After the plot is completed, the strip 21 is cut and ejected from the plotter, and the opaque strips 21A and 21B are removed. A high-tack-low-tack adhesive is used, with the high-tack side of the adhesive layer applied to the opaque strips 21A and 21B, and the low-tack side applied to the surface 21D of the medium strip 21. When the opaque strip is removed, the adhesive layer remains affixed to the opaque strip surface, so that no residue remains on the transparent medium 21.

It will be apparent that other materials may be used to fabricate the strips 21A and 21B. For example, a thin layer of aluminum can be employed, since its coefficient of thermal expansion is similar to bi-axially oriented PET in the X-Y plane and it has a reflectivity significantly greater than 30 percent.

The purpose of strip 21A is to provide a reflective surface with an outside edge which can be detected by the edge sensor 52. The width of strip 21A is relatively non-critical; a width of 16 mm have been found to trigger the edge sensor satisfactorily in one typical large scale plotter. The purpose of strip 21B is twofold, to trip the media sensor 56 and to provide a reflective surface with an outside edge which can be detected by the edge sensor 52. With the edge sensor positioned about 20 mm from the nominal location of the edge, a strip width of 31 mm has been found to operate satisfactorily in an exemplary large scale plotter.

It will be understood that the plotter device 10 is itself conventional in design and operation. It is the use of the new transparent print medium 21 having opaque reflective strips applied thereto which permits the plotter 10 to print images onto a transparent medium.

A method of forming an image onto a transparent medium by a printing device having optical edge and medium sensing functions is therefor provided by this invention. The method includes the following steps:

1. provide a transparent print medium having removably applied to a first surface thereof a reflective layer at a first lateral edge of the medium, a reflective layer at a second lateral edge of the medium, and reflective layer material intermediate to the lateral edges at a position for tripping a media sensor.
2. load the medium into the printing device media path and advance to the printing region past the media sensor;
3. use the media sensor to detect the presence of a print medium in the media path by interaction with reflective material, and enable printing operations;
4. activate the device printer element carriage to traverse the print region along a lateral swath axis having an extent wider than the width of the medium, activating the optical edge sensor to locate the lateral edges of the medium by location of the outer edges of the reflective layer material;
5. perform printing operations on a second surface of the print medium opposed from the first surface;
6. eject the medium from the device, and cut to length the medium on which image is printed; and
7. peel off the reflective layers from the medium.

Figure 6:
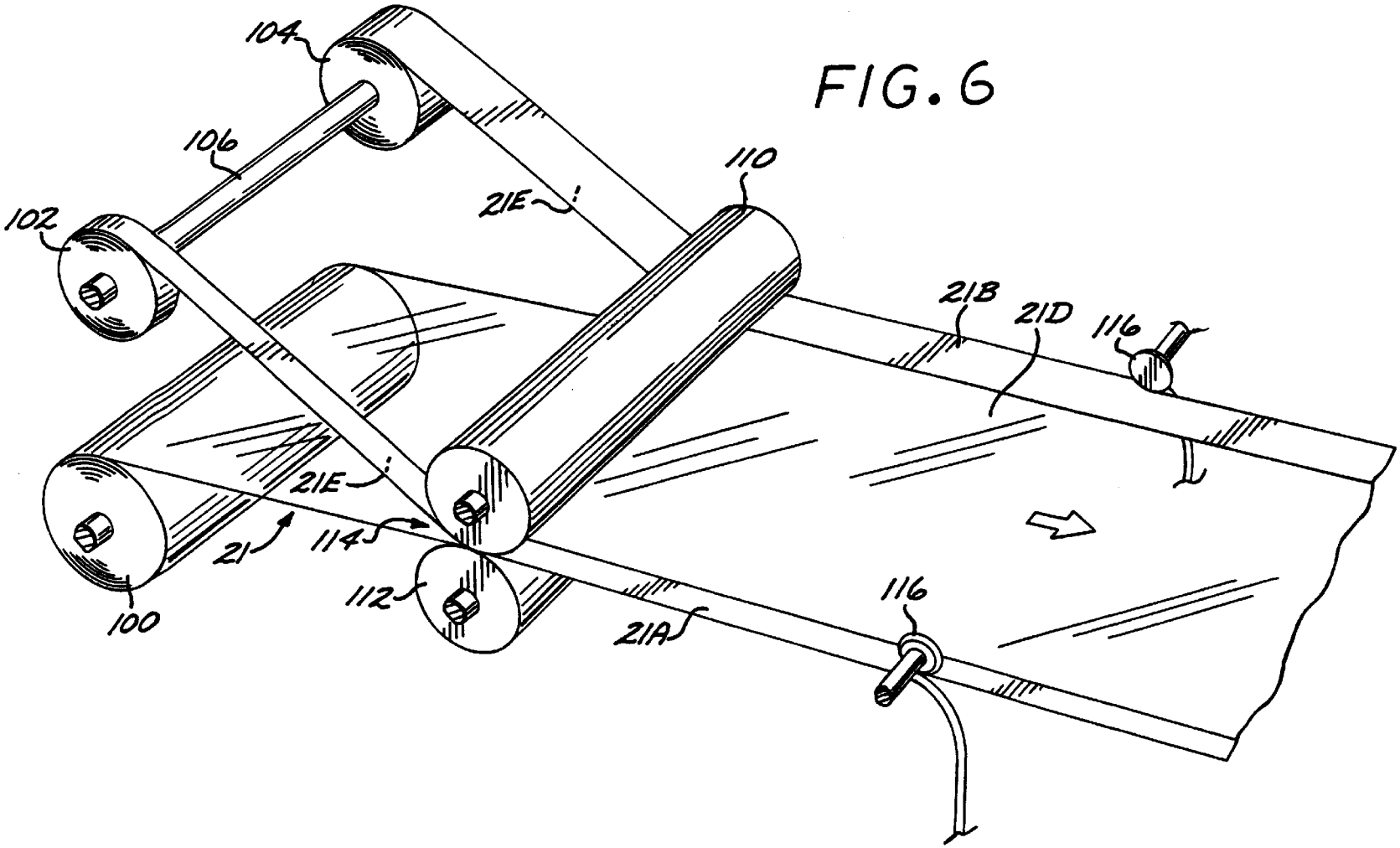
FIG. 6 illustrates an apparatus for applying the reflective strips to a transparent medium.

FIG. 6 illustrates in simplified schematic form a system for applying the strips 21A and 21B to the transparent medium 21. A supply of transparent PET is provided from roll 100. Rolls 102 and 104 of the narrow and wider opaque strips 21A and 21B having the adhesive layer 21E applied to one surface thereof (i.e., adhesive tape rolls) are supported on a rotatable shaft 106. The (transparent) medium with surface 21D up and the strips 21A and 21B are passed into the nip 114 of rollers 110 and 112. This pressure causes the adhesive layer 21E to come into contact with and adhere to the surface 21D of the transparent medium. Preferably the width of the medium 21 is slightly oversized, and trimming elements 116 are spaced apart by a distance equal to the nominal width of the finished medium 21. The trimming elements 116 include blades which trim away the excess material. The trimming operation also ensures that the outer edges of the transparent layer 21 and the opaque strips 21A and 21B coincide.

A given length of the medium 21 with the applied reflective strips, e.g., 75 feet, is then rolled up about the roll core 32 to provide the media roll loaded into the device 10. The use of the strips 21A and 21B results in concentration of the winding load on the rolls edges, at the strips 21A and 21B. The core is typically a spiral wound cardboard tube. If too much tension is applied when the medium is being wound about the core, the core can collapse due to the concentration of the load at the edges. Thus, the winding tension must be controlled to prevent core collapse. It is desired to use sufficient tension so that the layers do not slide appreciably relative to each other, and yet not so much tension that the core collapses.

Figure 4:
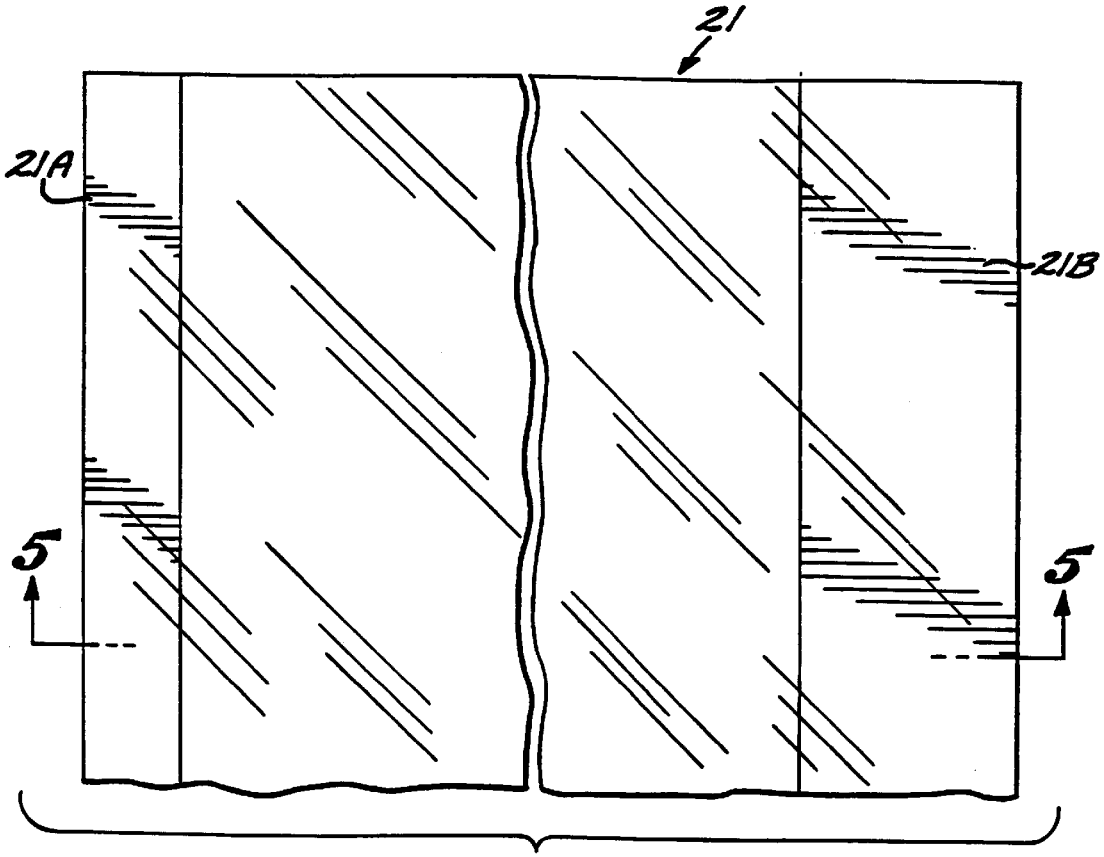
FIG. 4 is a top view of an exemplary embodiment of a transparent medium employing reflective strips in accordance with the invention.
Figure 5:
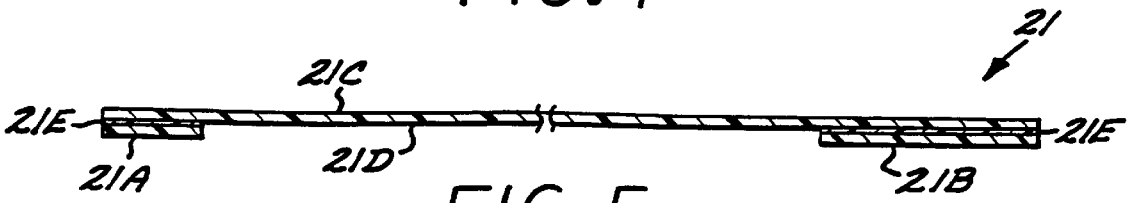
FIG. 5 is a cross-sectional view of the transparent medium of FIG. 4.
Figure 7:
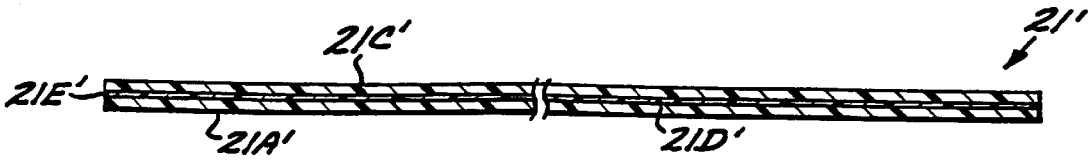
FIG. 7 is a cross-sectional view of an alternate embodiment of a transparent medium in accordance with the invention.

Rather than apply two strips of the reflective material to the transparent medium, a single layer can be applied, extending across the entire lateral extent of the print medium. This alternate embodiment is shown in FIG. 7, wherein the transparent medium 21' has applied to one surface a layer 21A' of reflective material by an adhesive layer 21E'. The reflective layer is fabricated of the same material as described above for layers 21A and 21B. An advantage of this embodiment over that shown in FIG. 4 is that winding tension control is less important, since the winding load will be distributed over the length of the core. A disadvantage of this embodiment is the added material cost and weight for the reflective layer, since more of the reflective material is required.

Figure 8:
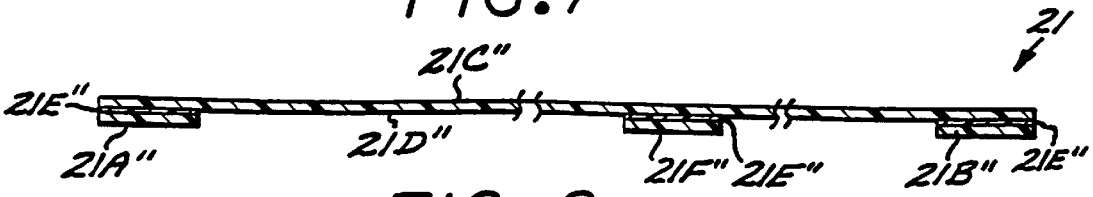
FIG. 8 is a cross-sectional view of a further alternate embodiment of a transparent medium in accordance with the invention.

FIG. 8 shows a further alternate embodiment of a transparent medium having reflective material applied thereto. In this case, three reflective strips 21A", 21B" and 21F" are applied to one surface of the transparent medium layer 21". Layer 21A" is identical to layer 21A described above regarding FIG. 4. However, to reduce the amount of reflective layer material used, two narrow reflective strips 21B" and 21F" are used in place of the single wide strip 21B. Strip 21B" is used only for the edge sensing function. Strip 21F" is located and used only to trip the media sensor 56. All three strips are of the same material as described above regarding the embodiment of FIG. 4, and are applied by use of the same pressure sensitive adhesive.

Figure 9:
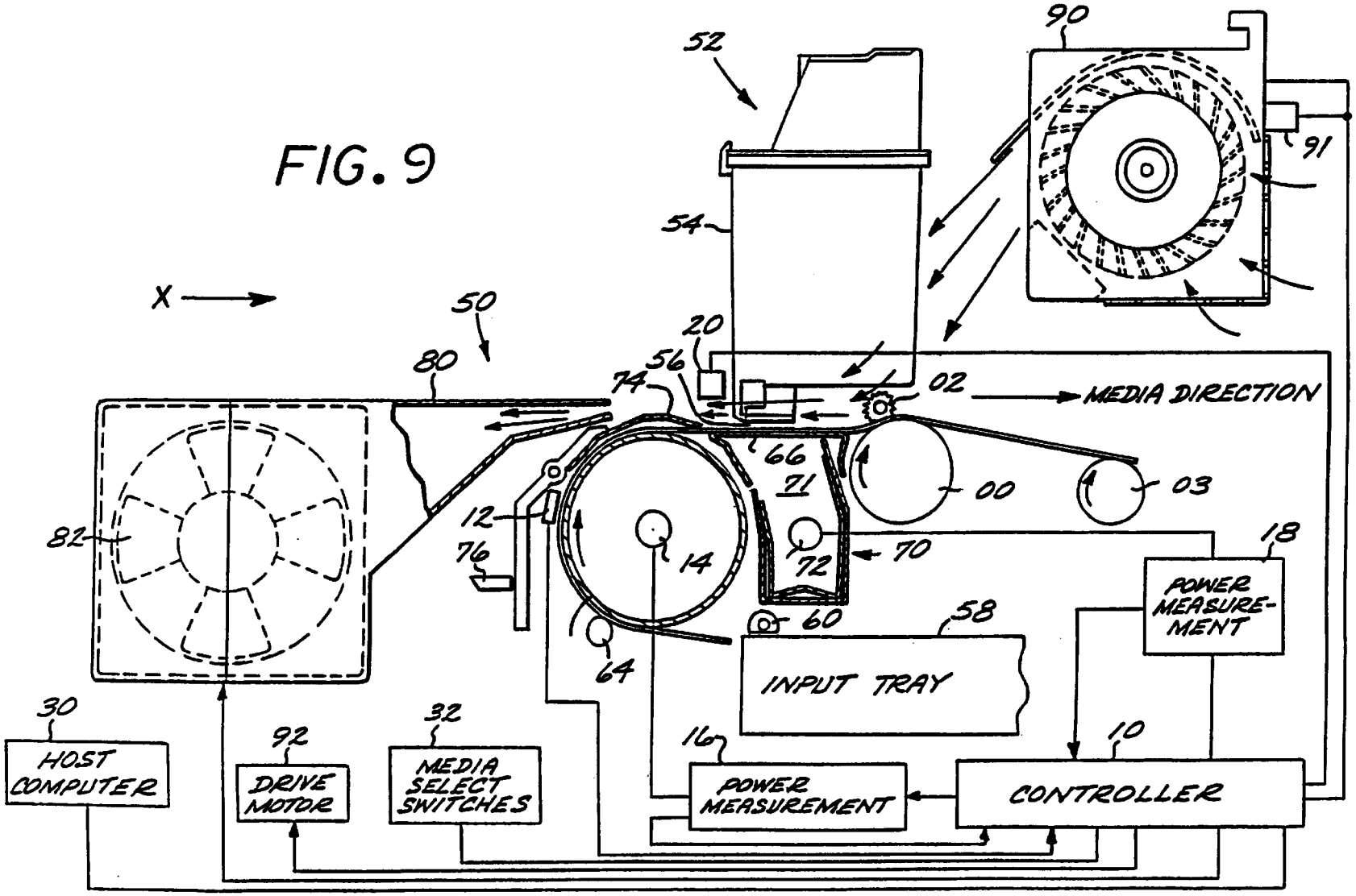
FIG. 9 is a schematic diagram of a sheet-fed ink-jet printer which supports printing onto a transparent medium in accordance with the invention.

In another embodiment, a sheet-fed printer device in accordance with this invention supports a special transparent polyester medium. Such a device 150 is illustrated in FIG. 9. The printer 150 includes a means for driving the print medium in the x direction, and for controlling the movement of a printhead, indicated generally as element 152 in FIG. 9, in the y direction (orthogonal to the plane of FIG. 9), in order to direct ink from the ink cartridges, shown generally as elements 154, onto a print medium at the print region 156. In this embodiment, the printhead 152 supports four ink cartridges for black, yellow, magenta and cyan inks, respectively. This embodiment achieves acceptable color print quality on plain paper media, even using a print resolution of 300 dots per inch. The printhead and its operation are described more fully in the commonly assigned co-pending application entitled "STAGGERED PENS IN COLOR THERMAL INK-JET PRINTER," May 1, 1992, Ser. No. 07/877,905, by B. W. Richtsmeier, A. N. Doan and M. S. Hickman, now U.S. Pat. No. 5,376,958 the entire contents of which are incorporated herein by this reference. As described therein, the yellow, magenta and cyan print cartridges are staggered, so that the print nozzles of each cartridge subtend non-overlapping regions at the print zone of the printer.

The ink cartridges 154 each hold a supply of water-based inks, to which color dyes have been added. As presently contemplated, the preferred ink formulation for use in the heated printing environment of the printer of this application is described in co-pending application Ser. No. 07/877,640, filed May 1, 1992, entitled "Ink-Jet Inks With Improved Colors and Plain Paper Capability," now U.S. Pat. No. 5,143,547 assigned to a common assignee with the present invention, the entire contents of which are incorporated herein by this reference.

The print medium in this embodiment is supplied in sheet form from a tray 158. A pick roller 160 is employed to advance the print medium from the tray 158 into engagement between drive roller 162 and idler roller 164. Exemplary types of print medium include plain paper, coated paper, glossy opaque polyester, and transparent polyester. Preferably the print medium is advanced in the manner described in U.S. Pat. No. 4,990,011, by John A. Underwood, Anthony W. Ebersole and Todd R. Medin, and assigned to a common assignee with the present application. The entire contents of the patent is incorporated herein by this reference. Accordingly, this part of the printer 150 will not be described in further detail herein.

The printer operation is controlled by a controller 210, which receives instructions and print data from a host computer 230 in the conventional manner. The host computer may be a workstation or personal computer, for example. The user may manually instruct the controller 210 as to the type of print medium being loaded via front panel medium selection switches 232. In this exemplary embodiment there are three switches 232, one for plain paper, one for coated paper (e.g., Hewlett-Packard special paper), and another for polyester. The front panel switch selection data is overridden if the data received from the host computer includes medium type data.

Once the print medium has been advanced into the nip between the drive and idler rollers 162 and 164, it is advanced further by the rotation of the drive roller 162. A stepper drive motor 192 is coupled via a gear train to roller 162 to drive the rollers 160, 162, 200 and 203 which drive the medium through the printer media path.

The print medium is fed to a print zone 156 beneath the area traversed by the cartridges 154 and over a print screen 166 which provides a means of supporting the medium at the print position. The screen 166 further allows efficient transfer of radiant and convective energy from the print heater cavity 171 to the print medium as well as providing a safety barrier by limiting access to the inside of the reflector 170.

While the medium is being advanced, a movable drive plate 174 is lifted by a cam 176 actuated by the printhead carriage. Once the print medium reaches the print zone 156, the drive plate 174 is dropped, holding the medium against the screen 166, and allowing minimum spacing between the print nozzles of the thermal ink-jet print cartridges and the medium. This control of the medium in the print zone is important for good print quality. Successive swaths are then printed onto the print medium by the ink-jet head comprising the different print cartridges 154.

A print heater halogen quartz bulb 172 disposed longitudinally under the print zone 156 supplies a balance of thermal radiation and convective energy to the ink drops and the print medium in order to evaporate the carrier in the ink. This heater allows dense plots (300 dots per inch in this embodiment) to be printed on plain paper (medium without special coatings) and achieve satisfactory output quality in an acceptable amount of time. The reflector 170 allows radiated energy to be focused in the print zone and maximizes the thermal energy available.

The printer 150 further includes a crossflow fan 190 located to direct an air flow from in front of the print zone to the print zone, to aid in drying inks and directing carrier vapors toward the evacuation duct 180 for removal.

An evacuation duct 180 leads to an evacuation fan 182. The duct defines the path used to remove ink vapors from around the print zone 156. The evacuation fan 182 pulls air and vapor from around the print zone into the duct 180 and out an evacuation opening. Evacuation of the ink vapors minimizes residue buildup on the printer mechanism.

An exit roller 200, starwheels 202 and an output stacking roller 203 work in conjunction with the heated drive roller 162 to advance and eject the print medium. The gear train driving the gears is arranged such that the exit roller drives the medium slightly faster than the roller 162 so that the printer medium is under some tension once engaged by the exit roller. The frictional force between the print medium and the respective rollers is somewhat less than the tensile strength of the print medium so there is some slippage of the print medium on the rollers. The tension facilities good print quality keeping the print medium flat under the print zone.

The operation of the various elements of the printer 150 is controlled by controller 210. A thermistor 212 is provided adjacent the drive roller 162 to provide an indication of the temperature of the roller 162 surface. Power is applied to the preheat bulb 214 disposed within the roller 162 via a power measurement circuit 216, permitting the controller to monitor the power applied to the bulb 214. Power is also supplied to the print heater bulb 172 via a power measurement circuit 218, permitting the controller to monitor the power level supplied to the bulb 172. An infrared sensor 220 is mounted adjacent the print zone on the printhead 152, and is used to detect the edges of the print medium and whether the medium is transparent in order to select the appropriate operating conditions for the print heater.

The printer 150 supports a special transparent polyester medium, wherein a white opaque strip about 0.5 inches wide is adhered to the back of the medium along its leading edge, extending across the width of the medium. The infrared sensor 220 located on the carriage 154 detects the presence or absence of the strip. By advancing the leading edge of the medium more than 0.5 inches past the sensor, the sharp reduction in energy reflected back to the sensor as the white strip is advanced beyond the sensor indicates that the medium is transparent. The white strip is also used by the sensor to detect the width of the transparent medium. Such an embodiment is particularly useful for sheet-fed ink-jet printers, for example, which support the use of sheets of print medium of a predetermined length. Thus, the printer device 150 need only be able to locate the sheet leading edge and lateral edges; the trailing edge position is determined from knowledge of the predetermined length. In such a case, the printer 150 need only employ a carriage-mounted optical sensor 220, since the sensor can be employed to detect the advancement of the leading edge of the print medium in the manner just described, and can also detect the location of the lateral edges in the same manner as performed by the plotter 10, i.e., by scanning the carriage across the printer swath range of movement, and noting the locations at which the sensor output changes significantly.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of forming an image onto a transparent print medium by an ink-jet printing device having an optical medium sensor for sensing edges of the transparent print medium, comprising the following steps:

providing a roll of a transparent print medium, the medium having affixed to a first surface thereof an opaque reflective layer coincident with lateral edges of the transparent medium and coterminous with a transverse edge of the transparent print medium;

loading the roll of the transparent print medium into the printer device such that said transverse edge extends orthogonally to a medium advance path of the printing device at a first lateral edge of the transparent print medium;

advancing the transparent print medium along the medium advance path to a device printing region;

using the optical sensor to locate lateral edges of the transparent print medium by location of outer edges of said opaque reflective layer and to enable ink-jet printing operations;

performing the ink-jet printing operations on a second surface of the transparent print medium opposed from the first surface to form an image on a portion of the roll of the print medium; and cutting the transparent print medium to separate the portion of the print medium from the roll.

2. The method of claim 1 further comprising the step of removing said opaque reflective layer from the transparent print medium after said printing operations have been completed.

3. The method of claim 1 further characterized in that said optical sensing means operates by sensing reflected optical energy from said opaque reflective layer, and said opaque reflective layer has in excess of thirty percent opacity.

4. The method of claim 1 wherein said transparent medium is a layer of transparent polyethylene terephthalate (PET), and said opaque reflective layer is defined by one or more layers of PET filled with barium sulfate to provide sufficient opacity to operate said sensing means.

5. A method of forming an image onto a transparent medium by an ink-jet printing device having an optical medium sensor disposed for operation along a medium path and an optical edge sensor disposed to sense lateral edges of the print medium, comprising the following steps:

providing a roll of a transparent print medium, the medium having removably affixed to a first surface thereof a first reflective layer portion at a first lateral edge of the medium, a second reflective layer portion at a second lateral edge of the medium, and a third reflective layer portion intermediate to the lateral edges at a position for tripping a media sensor;

loading said roll of print medium into the printing device and advancing a leading edge of said medium along the media path to the printing region past the optical medium sensor;

using the optical medium sensor to detect the presence of a print medium in the media path by interaction with reflective material;

using the optical edge sensor to locate the lateral edges of the medium by location of outer edges of said reflective layer material;

performing ink-jet printing operations on a portion of said roll on a second surface of said print medium opposed from the first surface.

6. The method of claim 5 further comprising the step of removing said reflective layer portions from the medium after said printing operations have been completed.

7. The method of claim 5 wherein said first reflective layer portion is defined by a first reflective strip of reflective layer material, and said second and third reflective layer portions are defined by a second reflective strip of reflective layer material.

8. The method of claim 7 wherein said optical medium sensor is arranged to detect a target area of print medium spaced a nominal sensor distance from said second lateral edge, and said second strip has a width at least as wide as said sensor distance.

9. The method of claim 5 further characterized in that said optical edge sensor and said optical medium sensor operate by sensing reflected optical energy from said reflective layer portions, and said reflective layer portions have in excess of thirty percent opacity.

10. The method of claim 5 wherein said transparent medium is a layer of transparent polyethylene terephthalate (PET), and said reflective layer portions are defined by one or more layers of PET filled with barium sulfate to provide sufficient opacity to operate said sensors.

11. The method of claim 5 wherein said first, second and third reflective layer portions are defined by a single layer of reflective material extending across the complete lateral extent of said transparent medium and removably affixed thereto by a pressure-sensitive adhesive.

12. The method of claim 11 wherein said transparent medium is a layer of transparent polyethylene terephthalate (PET), and said reflective layer is a layer of PET filled with barium sulfate to provide sufficient opacity to operate said sensors.

13. The method of claim 5 wherein said first, second and third reflective layer portions are respectively defined by first, second and third strip layers of a reflective material.

14. The method of claim 13 wherein said transparent medium is a layer of transparent polyethylene terephthalate (PET), and said reflective strip layers each are one layer of PET filled with barium sulfate to provide sufficient opacity to operate said sensors.

15. The method of claim 5 further comprising:

cutting the transparent print medium to separate the portion of the print medium from the roll.

* * * * *